US012256825B2

(12) United States Patent
Chan

(10) Patent No.: US 12,256,825 B2
(45) Date of Patent: Mar. 25, 2025

(54) STICK PRODUCT REFILL SYSTEM

(71) Applicant: NV International (Asia) Limited, Kowloon Bay (HK)

(72) Inventor: Kin Ming Kevin Chan, Kowloon Bay (HK)

( * ) Notice: Subject to any disclaimer, the term of this patent is extended or adjusted under 35 U.S.C. 154(b) by 818 days.

(21) Appl. No.: 17/493,858

(22) Filed: Oct. 5, 2021

(65) Prior Publication Data

US 2023/0105259 A1 Apr. 6, 2023

(51) Int. Cl.

| | |
|---|---|
| ***A45D 40/06*** | (2006.01) |
| ***A45D 40/02*** | (2006.01) |
| ***A45D 40/16*** | (2006.01) |
| *A45D 40/00* | (2006.01) |

(52) U.S. Cl.

CPC ..... *A45D 40/16* (2013.01); *A45D 40/02* (2013.01); *A45D 40/06* (2013.01); *A45D 40/065* (2013.01); *A45D 2040/0037* (2013.01); *A45D 2200/25* (2013.01)

(58) Field of Classification Search

CPC ..... A45D 40/02; A45D 40/06; A45D 40/065; A45D 40/16; A45D 2040/0037

See application file for complete search history.

(56) References Cited

U.S. PATENT DOCUMENTS

| | | | | |
|---|---|---|---|---|
| 11,330,890 | B2 * | 5/2022 | Trochel | A45D 40/06 |
| 11,382,399 | B2 * | 7/2022 | Chan | B29C 39/02 |

* cited by examiner

*Primary Examiner* — Jennifer C Chiang

(57) ABSTRACT

A system for refilling a dispenser includes a refill assembly having refill base, a refill stick receptacle and a refill cover, and a dispenser having a dispenser stick receptacle a stick receptacle carrier and a propel-repel mechanism for longitudinally advancing and retracting the stick receptacle carrier within the dispenser. The dispenser stick receptacle is configured to be replaced by the refill stick receptacle by (1) removing the refill base from the refill cover with the refill stick receptacle engaged with the refill cover; (2) engaging the refill base with the dispenser stick receptacle and then removing the dispenser stick receptacle from the stick receptacle carrier by pulling the refill base away from the stick receptacle carrier; (3) engaging the refill cover with the refill stick receptacle engaged therewith with the stick receptacle carrier; and (4) removing the refill cover by pulling the refill cover away from the stick receptacle carrier.

12 Claims, 13 Drawing Sheets

STICK PRODUCT REFILL SYSTEM

BACKGROUND OF THE INVENTION

The present invention relates to the general field of stick products and their dispensers, and more particularly to stick product refills.

Stick products, such as lipsticks and deodorants, are commonly used in dispensers having a propel-repel mechanism, in which a threaded spindle is turned to longitudinally advance and retract a receptacle which holds the stick product. In existing dispenser systems, when the stick product is exhausted, at most the outer casing of the dispenser can be re-used, but the propel-repel mechanism is discarded. The present invention provides a system by which the stick product can be refilled without discarding the dispenser's propel-repel mechanism, thereby advancing the purposes of recycling and resource conservation, as well as providing cost savings to consumers.

BRIEF SUMMARY OF THE INVENTION

In view of the aforesaid disadvantages now present in the prior art, it is an object of the present invention to provide a stick product refill system which is convenient for users to replace the exhausted stick product with a stick product refill.

To attain this, the present invention provides a system for refilling a dispenser. The system comprises a refill assembly and a dispenser. The refill assembly comprises a refill base, a refill stick receptacle which retains a refill stick product and a refill cover. The dispenser comprises a dispenser stick receptacle which retains a dispenser stick product, a stick receptacle carrier and a propel-repel mechanism for longitudinally advancing and retracting the stick receptacle carrier within the dispenser. The refill base is removably engaged with the refill stick receptacle and/or the refill cover with a first retention force therebetween; the refill cover is removably engaged with the refill stick receptacle with a second retention force therebetween; the second retention force is higher than the first retention force. The dispenser stick receptacle is removably engaged with the stick receptacle carrier with a third retention force therebetween; the refill base is removably engaged with the dispenser stick receptacle with a fourth retention force therebetween; the fourth retention force is higher than the third retention force. The refill stick receptacle is removably engaged with the stick receptacle carrier with a fifth retention force therebetween; the fifth retention force is higher than the second retention force. The dispenser stick receptacle is configured to be replaced by the refill stick receptacle by (1) removing the refill base from the refill cover with the refill stick receptacle engaged with the refill cover; (2) engaging the refill base with the dispenser stick receptacle and then removing the dispenser stick receptacle from the stick receptacle carrier by pulling the refill base away from the stick receptacle carrier; (3) engaging the refill cover with the refill stick receptacle engaged therewith with the stick receptacle carrier; and (4) removing the refill cover by pulling the refill cover away from the stick receptacle carrier.

Particularly, the refill base is removably engaged with the refill stick receptacle and/or the refill cover by mechanical or magnetic means; the refill cover is removably engaged with the refill stick receptacle by mechanical or magnetic means; the dispenser stick receptacle is removably engaged with the stick receptacle carrier by mechanical or magnetic means; the refill base is removably engaged with the dispenser stick receptacle by mechanical or magnetic means; the refill stick receptacle is removably engaged with the stick receptacle carrier by mechanical or magnetic means.

Preferably, the mechanical or magnetic means for removably engaging the refill cover with the refill stick receptacle is substantially the same as the mechanical or magnetic means for removably engaging the refill base with the dispenser stick receptacle; the mechanical or magnetic means for removably engaging the dispenser stick receptacle with the stick receptacle carrier is substantially the same as the mechanical or magnetic means for removably engaging the refill stick receptacle with the stick receptacle carrier.

In one embodiment, the refill base has an upper portion proximal to the refill stick receptacle, and the upper portion of the refill base is engaged with an upper portion of the dispenser stick receptacle which is distal from the stick receptacle carrier.

In one embodiment, the refill base is provided with a plurality of vertical ribs extending from an inner wall thereof; the plurality of vertical ribs are in friction fit with an outer wall of the refill stick receptacle so as to establish the first retention force between the refill base and the refill stick receptacle. Alternatively or additionally, the refill cover has a bottom edge which is in friction fit or snap fit with a peripheral rim of the refill base so as to establish the first retention force between the refill base and the refill cover.

In one embodiment, the refill cover is provided with an annular rib around an inner wall thereof; the refill stick receptacle is provided with a plurality of beads around an outer wall thereof and an annular limiting rib below the plurality of beads; the annular rib is removably engaged with the plurality of beads so as to establish the second retention force between the refill cover and the refill stick receptacle, and the annular rib is limited in position by the annular limiting rib when engaging with the plurality of beads.

In one embodiment, the dispenser stick receptacle is provided with a plurality of L-shaped legs at a bottom end thereof; the plurality of L-shaped legs snap into engagement with an opening at a bottom end of the stick receptacle carrier so as to establish the third retention force between the dispenser stick receptacle and the stick receptacle carrier.

In one embodiment, a metal plate is fastened at a bottom end of the dispenser stick receptacle; a magnet magnetically attractive to the metal plate is affixed at a bottom end of the stick receptacle carrier so as to establish the third retention force between the dispenser stick receptacle and the stick receptacle carrier.

In one embodiment, the refill base is provided with an annular rib around an inner wall thereof; the dispenser stick receptacle is provided with a plurality of beads around an outer wall thereof and an annular limiting rib below the plurality of beads; the annular rib is removably engaged with the plurality of beads so as to establish the fourth retention force between the refill base and the dispenser stick receptacle, and the annular rib is limited in position by the annular limiting rib when engaging with the plurality of beads.

In one embodiment, the refill stick receptacle is provided with a plurality of L-shaped legs at a bottom end thereof; the plurality of L-shaped legs snap into engagement with an opening at a bottom end of the stick receptacle carrier so as to establish the fifth retention force between the refill stick receptacle and the stick receptacle carrier.

In one embodiment, a metal plate is fastened at a bottom end of the refill stick receptacle; a magnet magnetically attractive to the metal plate is affixed at a bottom end of the stick receptacle carrier so as to establish the fifth retention force between the refill stick receptacle and the stick receptacle carrier.

DETAILED DESCRIPTION OF THE INVENTION

Figure 1:
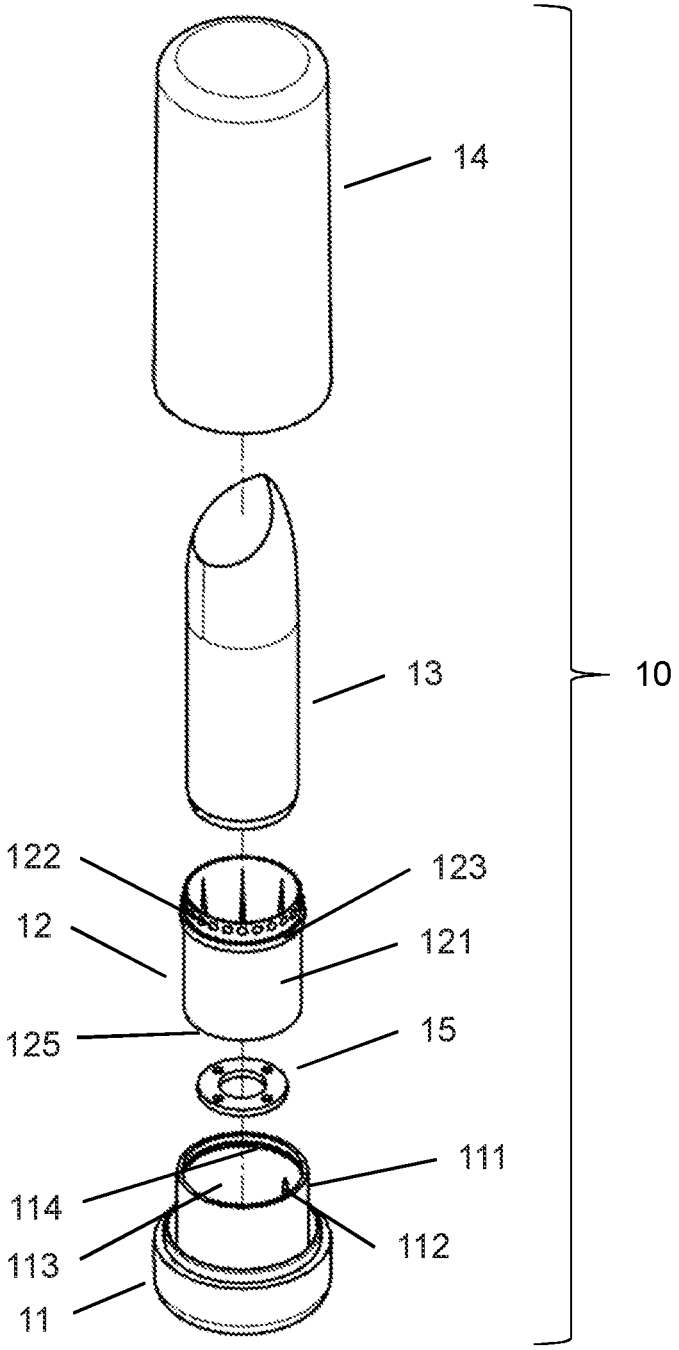
FIG. 1 is a disassembling view of the refill assembly of the first embodiment.
Figure 2:
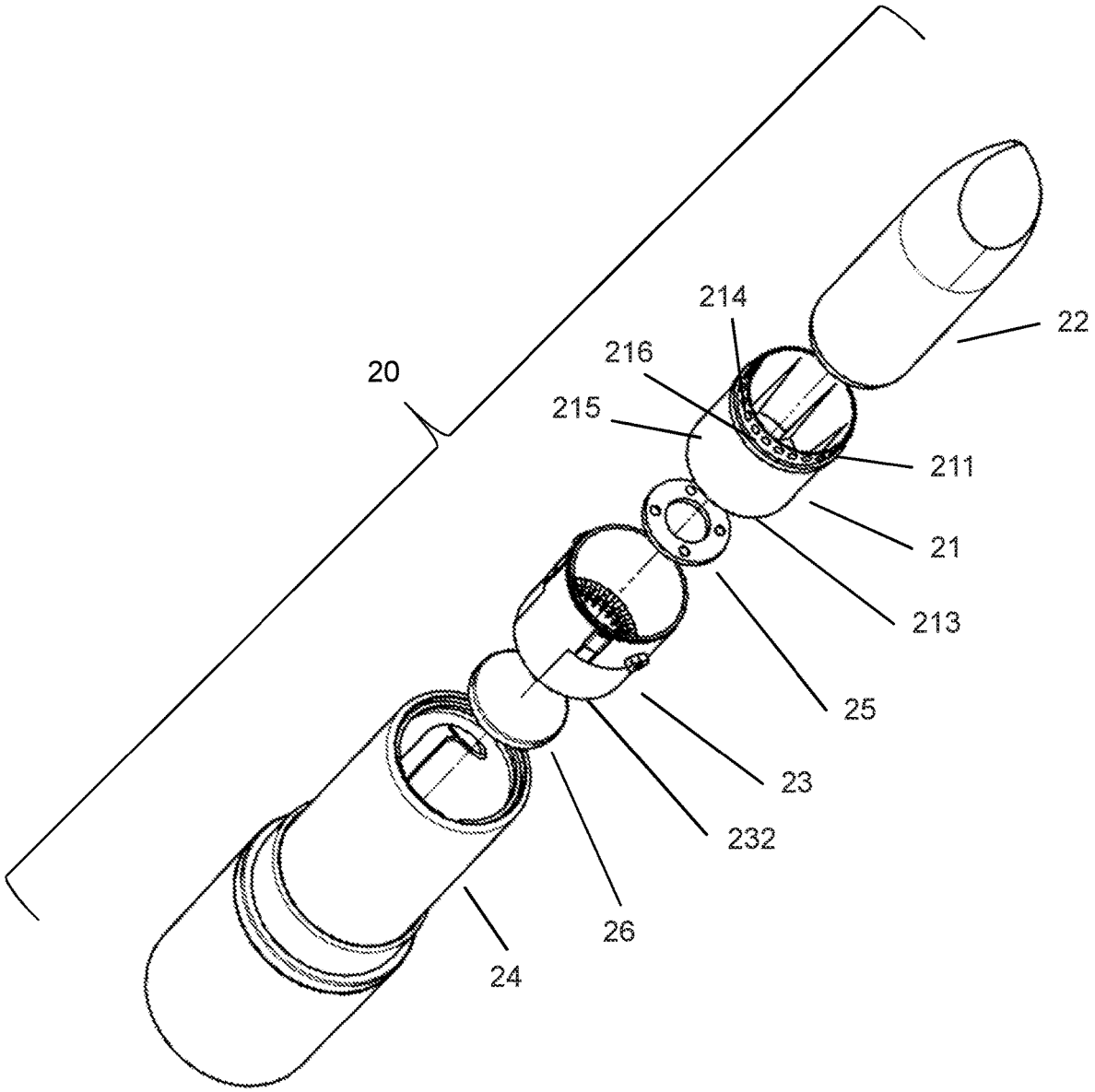
FIG. 2 is a disassembling view of the dispenser of the first embodiment.
Figure 3:
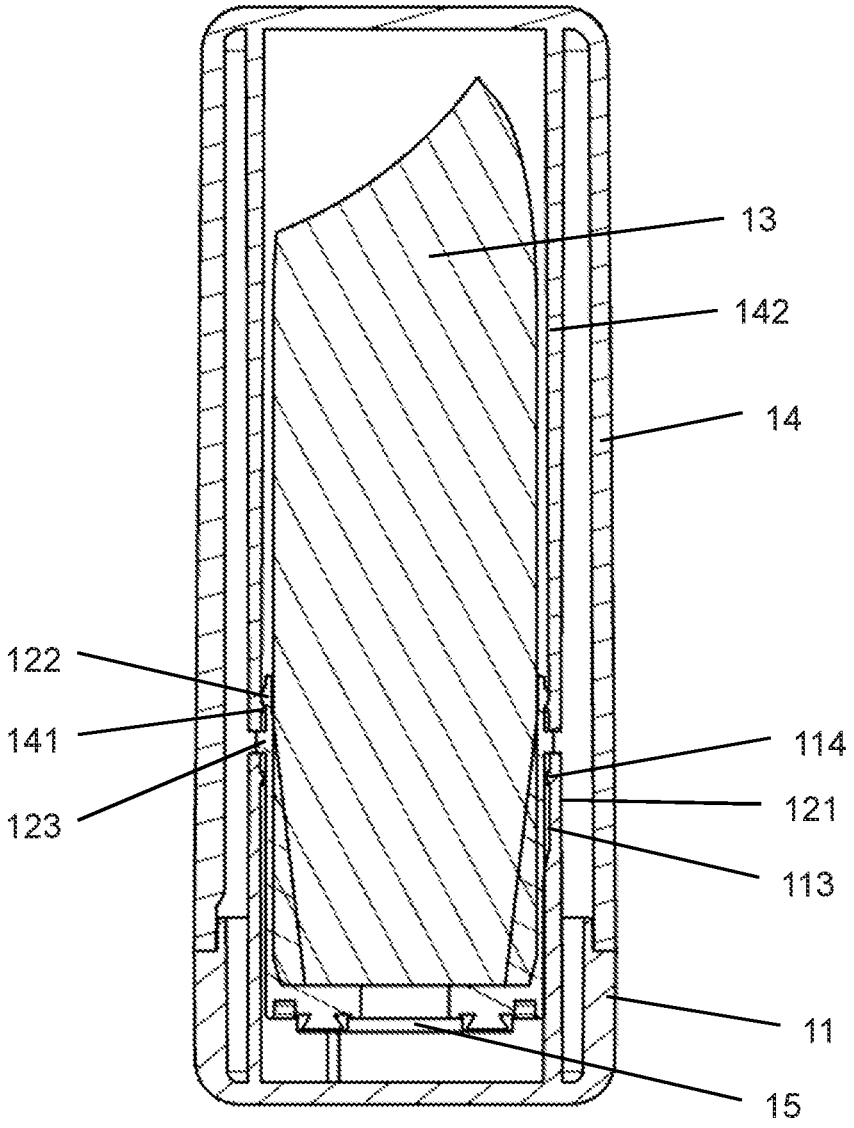
FIG. 3 is a sectional view of the refill base being engaged with the refill cover in the first embodiment.
Figure 4:
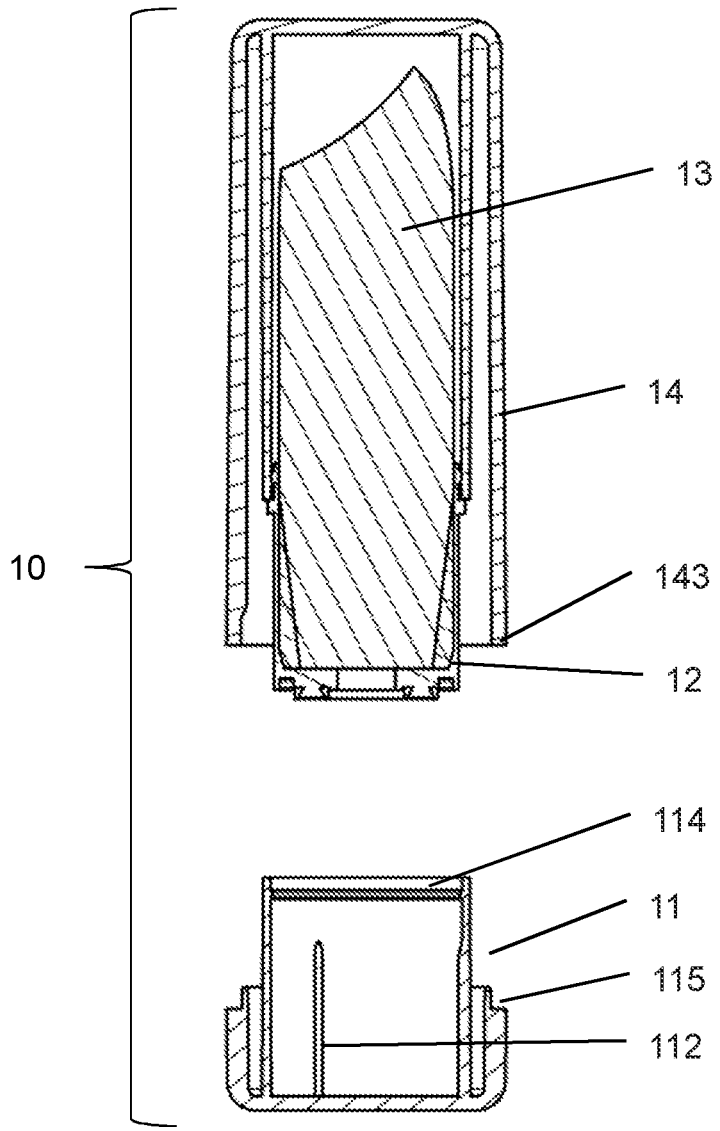
FIG. 4 is a sectional view of the refill base being removed from the refill cover in the first embodiment.
Figure 5:
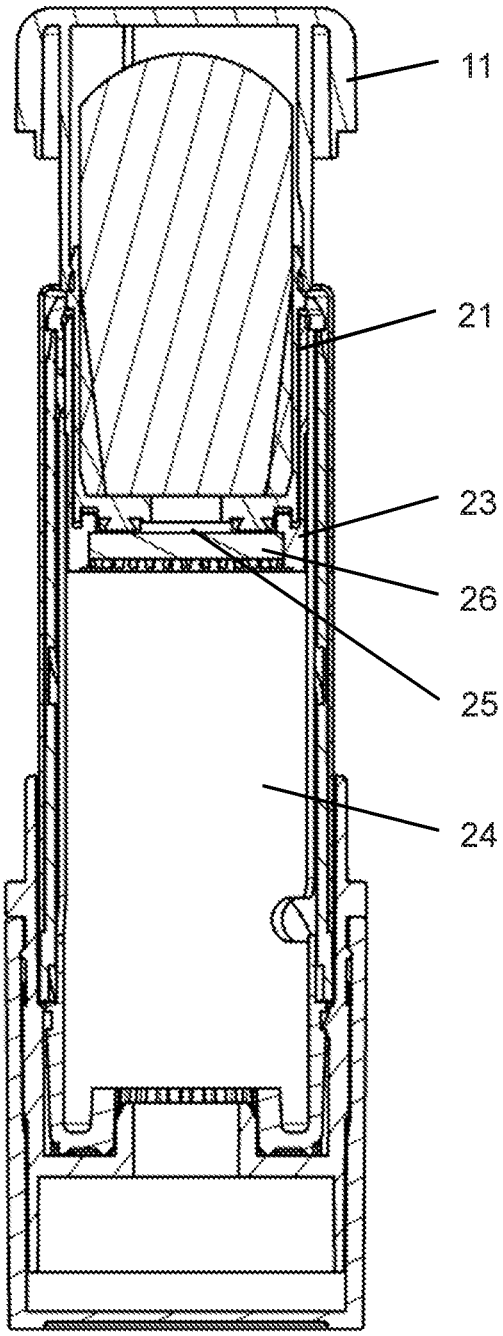
FIG. 5 is a sectional view of the refill base being engaged with the dispenser stick receptacle in the first embodiment.
Figure 6:
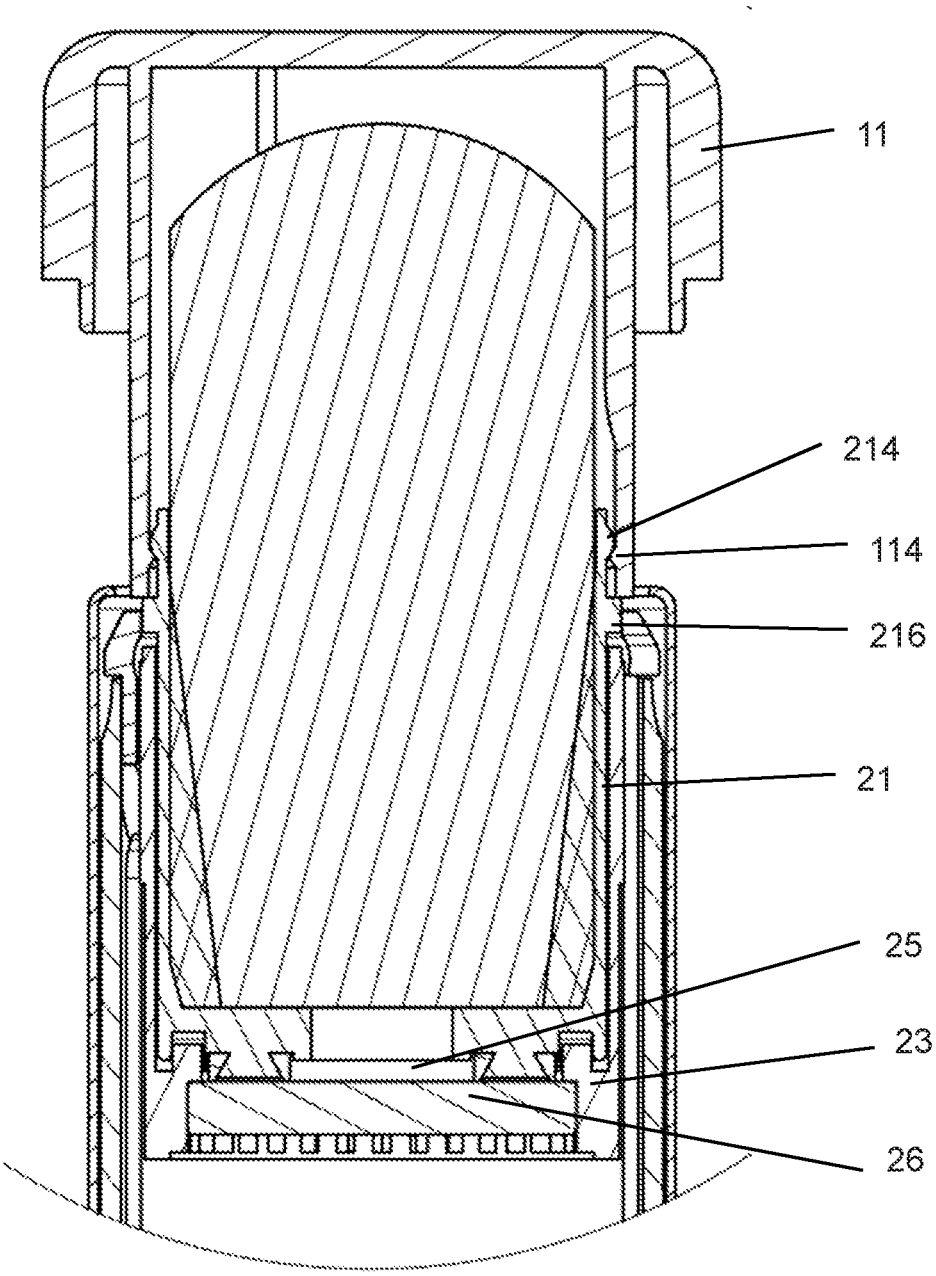
FIG. 6 is an enlarged sectional view of FIG. 5.
Figure 7:
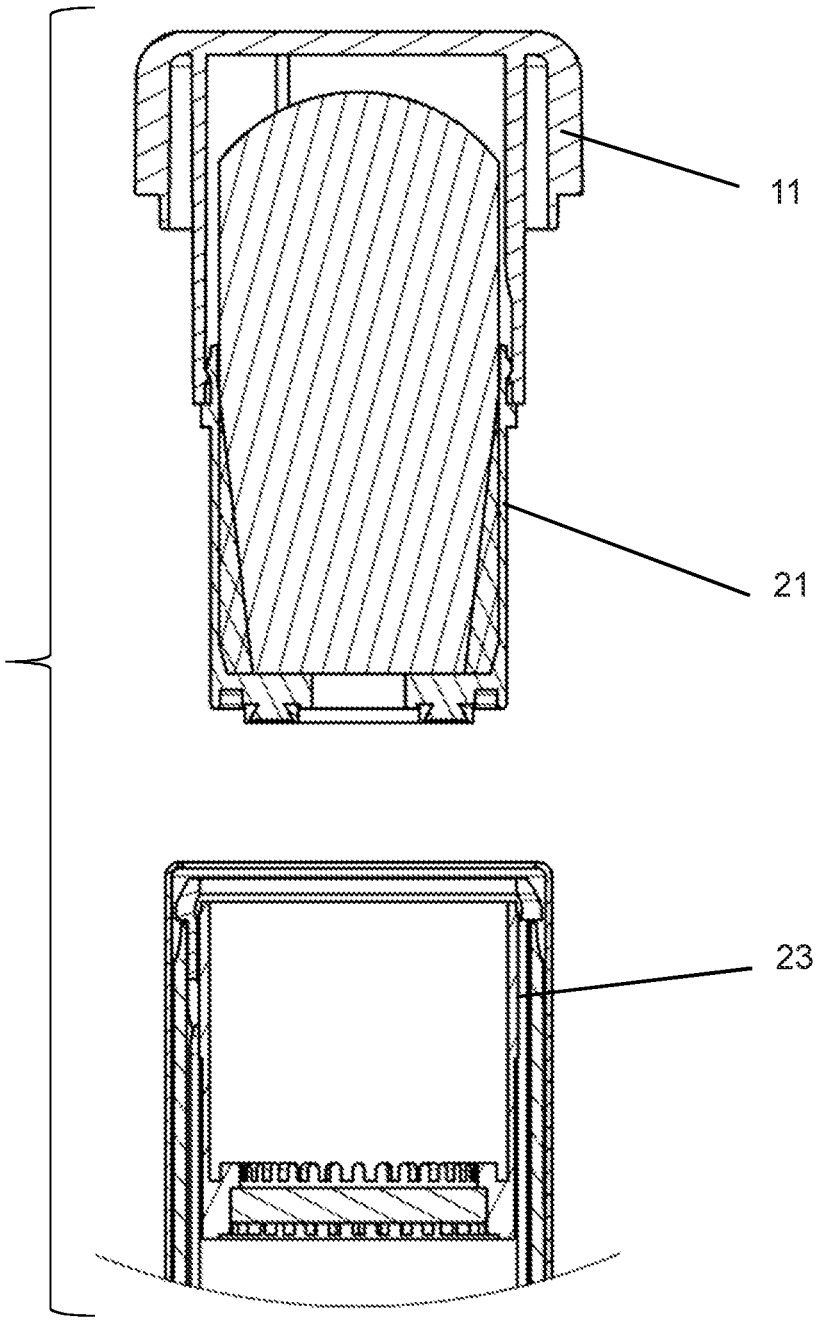
FIG. 7 is an enlarged sectional view of the refill base together with the dispenser stick receptacle being removed from the stick receptacle carrier in the first embodiment.
Figure 8:
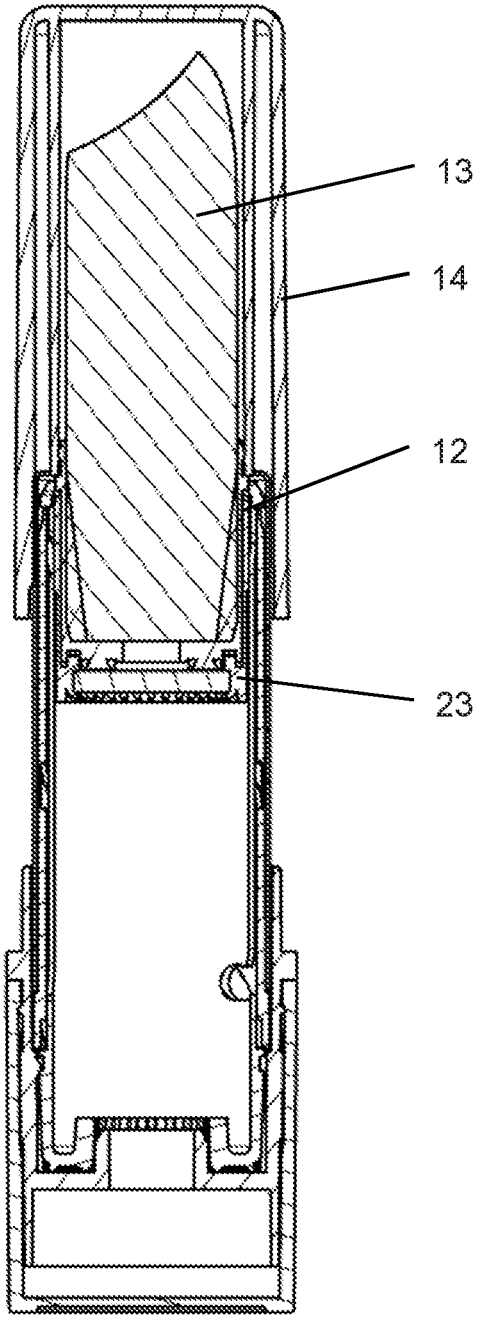
FIG. 8 is a sectional view of the refill cover with the refill stick receptacle engaged therewith being engaged with the stick receptacle carrier in the first embodiment.
Figure 9:
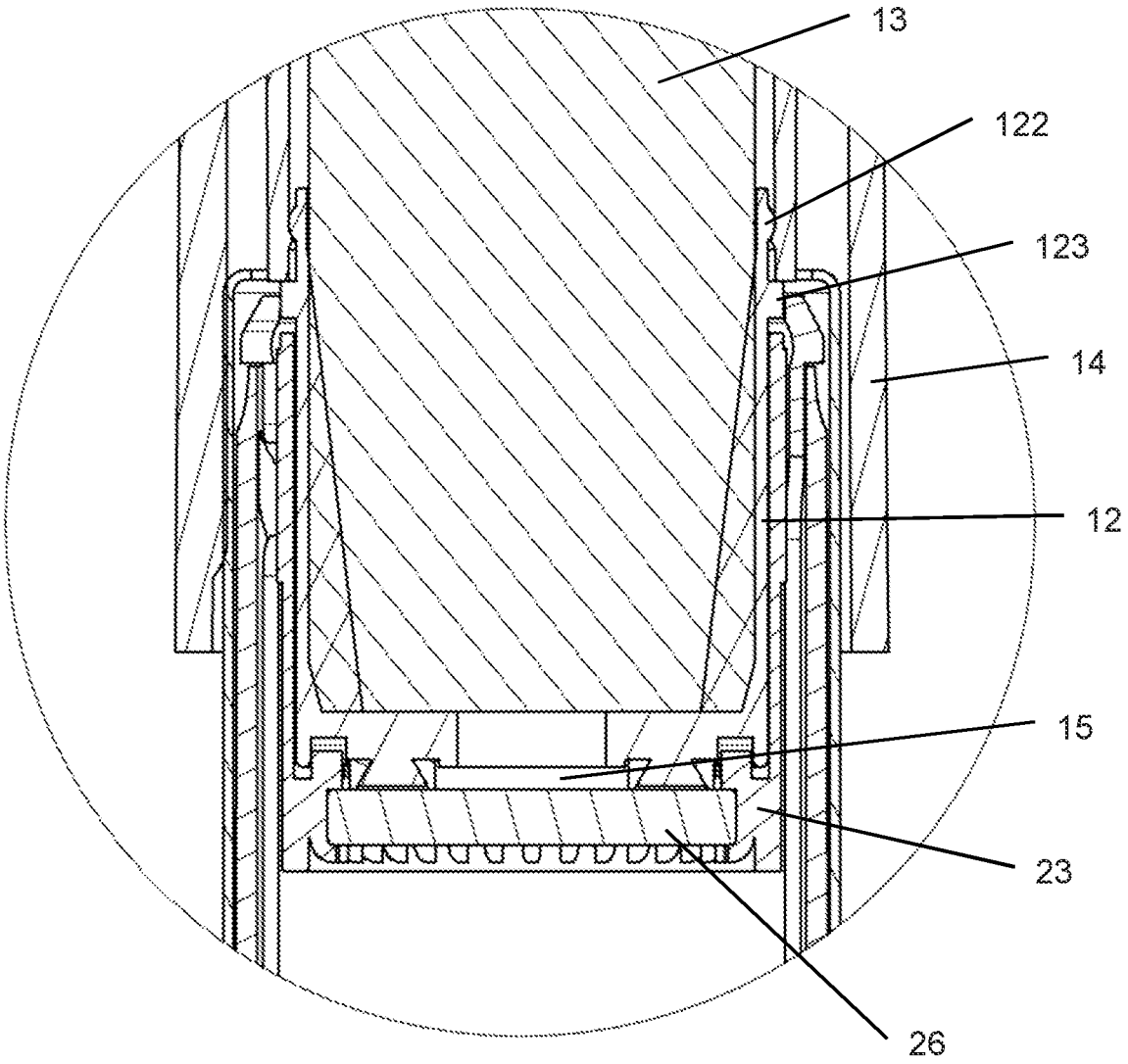
FIG. 9 is an enlarged sectional view of FIG. 8.
Figure 10:
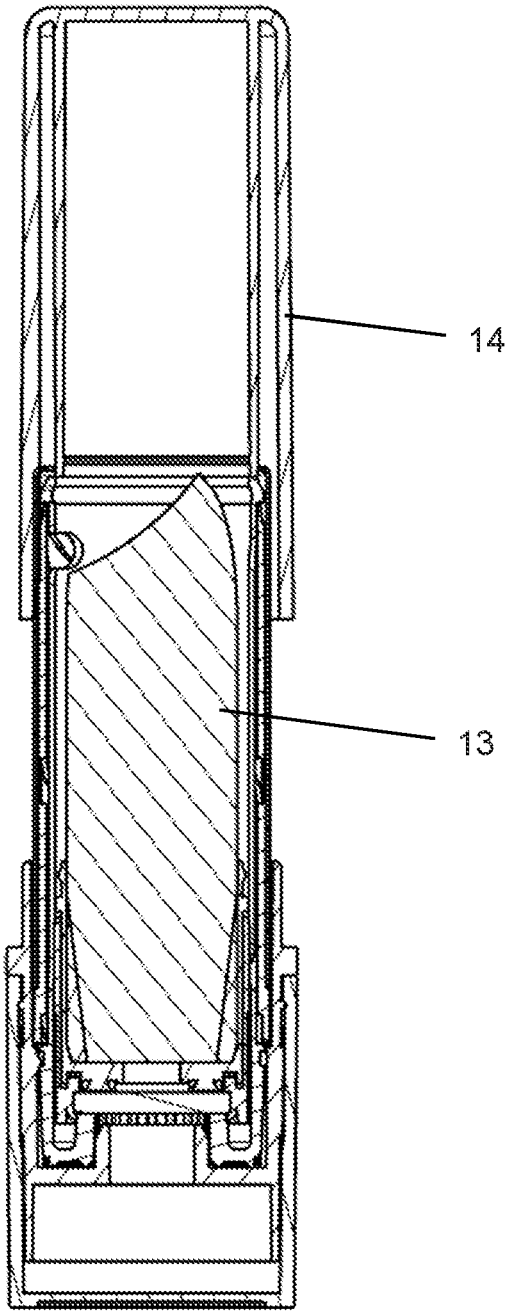
FIG. 10 is a sectional view of the refill stick receptacle being removed from the refill cover in the first embodiment.

FIGS. 1 to 10 illustrate the first embodiment of the present invention which provides a system for refilling a dispenser 20. The system comprises a refill assembly 10 and a dispenser 20. The refill assembly 10 comprises a refill base 11, a refill stick receptacle 12 which retains a refill stick product 13 and a refill cover 14. The dispenser 20 comprises a dispenser stick receptacle 21 which retains a dispenser stick product 22, a stick receptacle carrier 23 and a propel-repel mechanism 24 for longitudinally advancing and retracting the stick receptacle carrier 23 within the dispenser 20. The propel-repel mechanism 24 is available in the prior art and is therefore not detailed herein. The refill base 11 is removably engaged with the refill stick receptacle 12 and/or the refill cover 14 with a first retention force therebetween; the refill cover 14 is removably engaged with the refill stick receptacle 12 with a second retention force therebetween; the second retention force is higher than the first retention force. The dispenser stick receptacle 21 is removably engaged with the stick receptacle carrier 23 with a third retention force therebetween; the refill base 11 is removably engaged with the dispenser stick receptacle 21 with a fourth retention force therebetween; the fourth retention force is higher than the third retention force. The refill stick receptacle 12 is removably engaged with the stick receptacle carrier 23 with a fifth retention force therebetween; the fifth retention force is higher than the second retention force.

Various means such as mechanical means, magnetic means or the like are possible for removably engaging the refill base 11 with the refill stick receptacle 12 and/or the refill cover 14, the refill cover 14 with the refill stick receptacle 12, the dispenser stick receptacle 21 with the stick receptacle carrier 23, the refill base 11 with the dispenser stick receptacle 21, and the refill stick receptacle 12 with the stick receptacle carrier 23. Mechanical means may take the form of friction fit, mating snapping elements or the like.

In this embodiment, the refill base 11 is provided with a plurality of vertical ribs 112 extending from an inner wall 113 thereof; the plurality of vertical ribs 112 are in friction fit with an outer wall 121 of the refill stick receptacle 12 so as to establish the first retention force between the refill base 11 and the refill stick receptacle 12. Alternatively or additionally, the refill cover 14 has a bottom edge 143 which is in friction fit or snap fit with a peripheral rim 115 of the refill base 11 so as to establish the first retention force between the refill base 11 and the refill cover 14.

In this embodiment, the means for removably engaging the refill cover 14 with the refill stick receptacle 12 is substantially the same as the means for removably engaging the refill base 11 with the dispenser stick receptacle 21; the means for removably engaging the dispenser stick receptacle 21 with the stick receptacle carrier 23 is substantially the same as the means for removably engaging the refill stick receptacle 12 with the stick receptacle carrier 23.

More particularly, the refill cover 14 is provided with an annular rib 141 around an inner wall 142 thereof; the refill stick receptacle 12 is provided with a plurality of beads 122 around the outer wall 121 thereof and an annular limiting rib 123 below the plurality of beads 122; the annular rib 141 is removably engaged with the plurality of beads 122 so as to establish the second retention force between the refill cover 14 and the refill stick receptacle 12, and the annular rib 141 is limited in position by the annular limiting rib 123 when engaging with the plurality of beads 122. The refill base 11 has an upper portion 111 proximal to the refill stick receptacle 12, and the upper portion 111 of the refill base 11 is engaged with an upper portion 211 of the dispenser stick receptacle 21 which is distal from the stick receptacle carrier 23. The upper portion 111 of the refill base 11 is provided with an annular rib 114 around an inner wall 113 thereof; the upper portion 211 of the dispenser stick receptacle 21 is provided with a plurality of beads 214 around an outer wall 215 thereof and an annular limiting rib 216 below the plurality of beads 214; the annular rib 114 is removably engaged with the plurality of beads 214 so as to establish the fourth retention force between the refill base 11 and the dispenser stick receptacle 21, and the annular rib 114 is limited in position by the annular limiting rib 216 when engaging with the plurality of beads 214.

A metal plate 25 (a steel plate in this embodiment) is fastened at a bottom end 213 of the dispenser stick receptacle 21; a magnet 26 magnetically attractive to the metal plate 25 is affixed at a bottom end 232 of the stick receptacle carrier 23 so as to establish the third retention force between the dispenser stick receptacle 21 and the stick receptacle carrier 23. A metal plate 15 (a steel plate in this embodiment) magnetically attractive to the magnet 26 is fastened at a bottom end 125 of the refill stick receptacle 12 so as to establish the fifth retention force between the refill stick receptacle 12 and the stick receptacle carrier 23.

The dispenser stick receptacle 21 is configured to be replaced by the refill stick receptacle 12 by (1) removing the refill base 11 from the refill cover 14 with the refill stick receptacle 12 engaged with the refill cover 14; (2) engaging the refill base 11 with the dispenser stick receptacle 21 and then removing the dispenser stick receptacle 21 from the stick receptacle carrier 23 by pulling the refill base 11 away from the stick receptacle carrier 23; (3) engaging the refill cover 14 with the refill stick receptacle 12 engaged therewith with the stick receptacle carrier 23; and (4) removing the refill cover 14 by retracting the stick receptacle carrier 23 within the dispenser 20 and then pulling the refill cover 14 away from the stick receptacle carrier 23.

Figure 11:
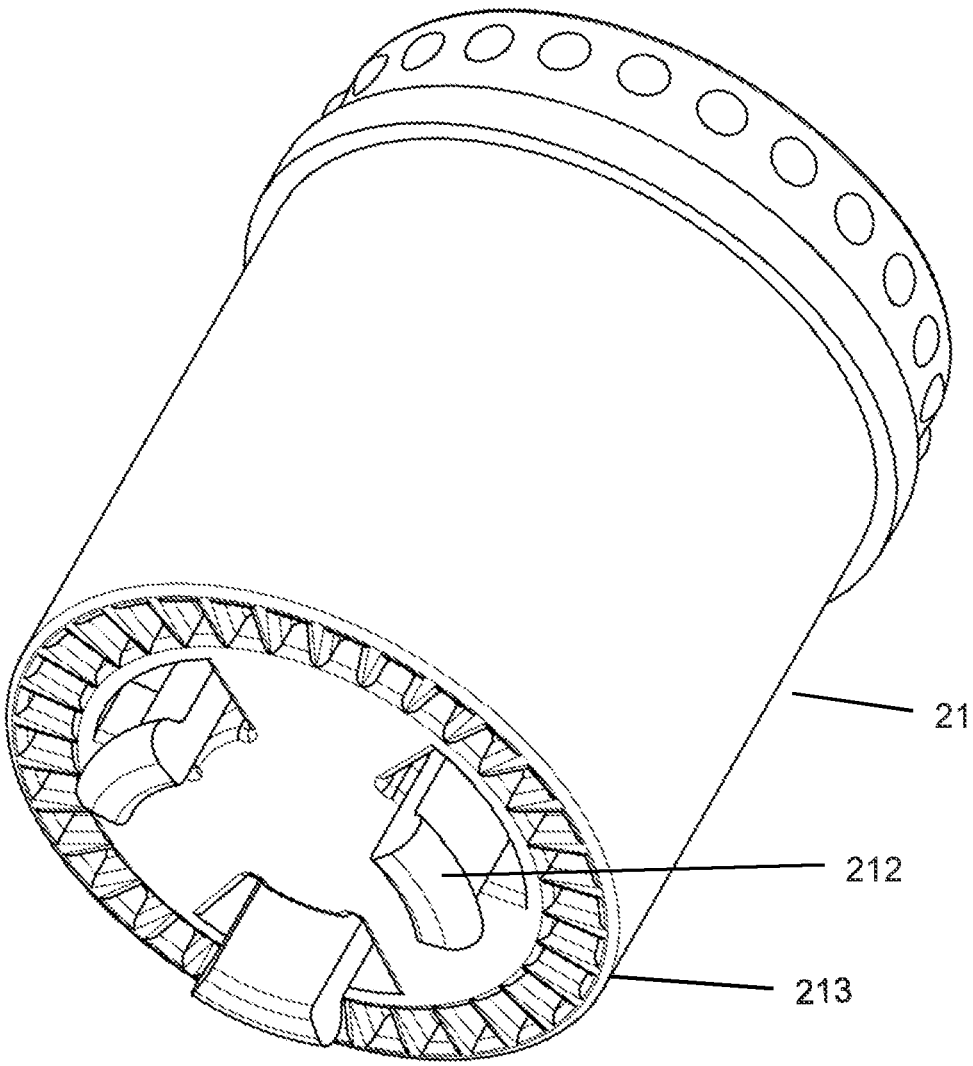
FIG. 11 is a perspective view of the dispenser stick receptacle of the second embodiment.
Figure 12:
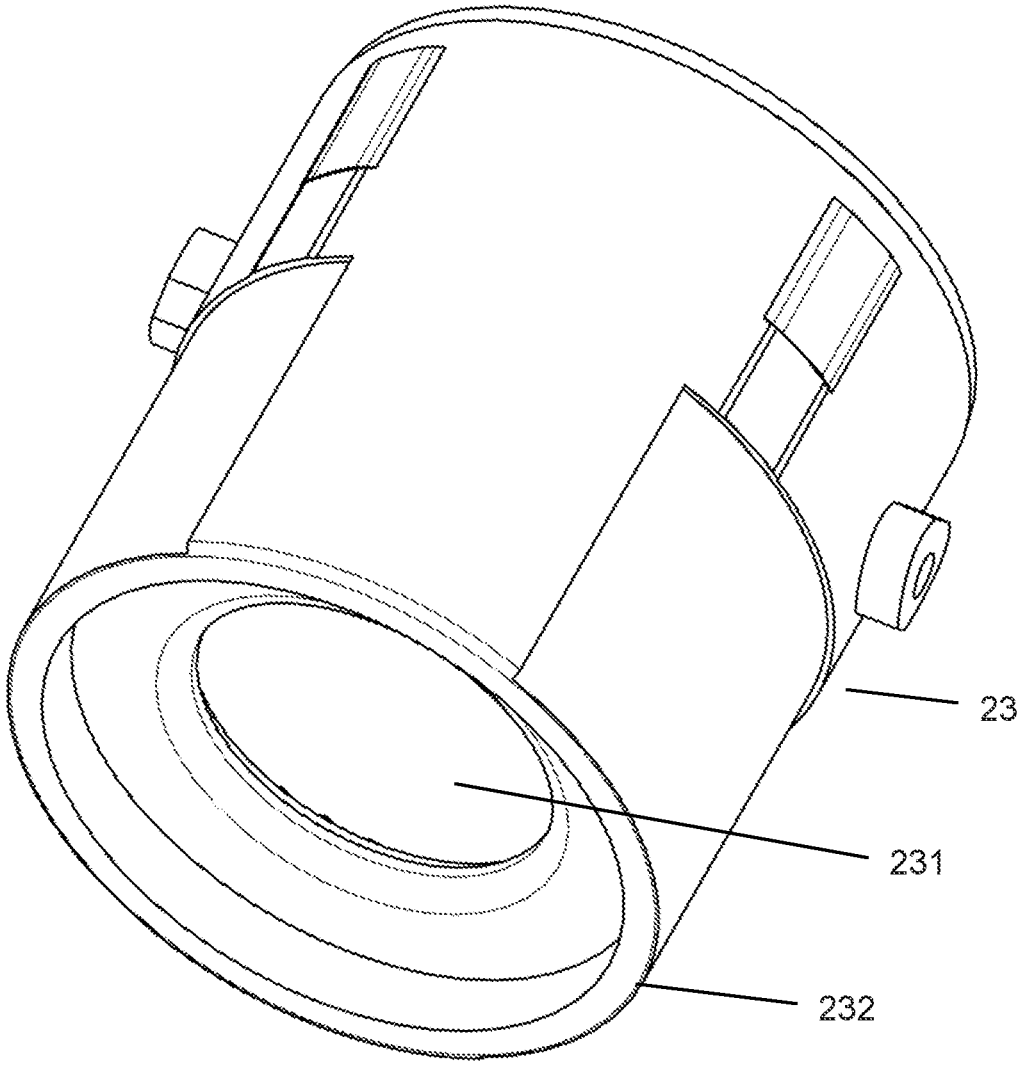
FIG. 12 is a perspective view of the stick receptacle carrier of the second embodiment.
Figure 13:
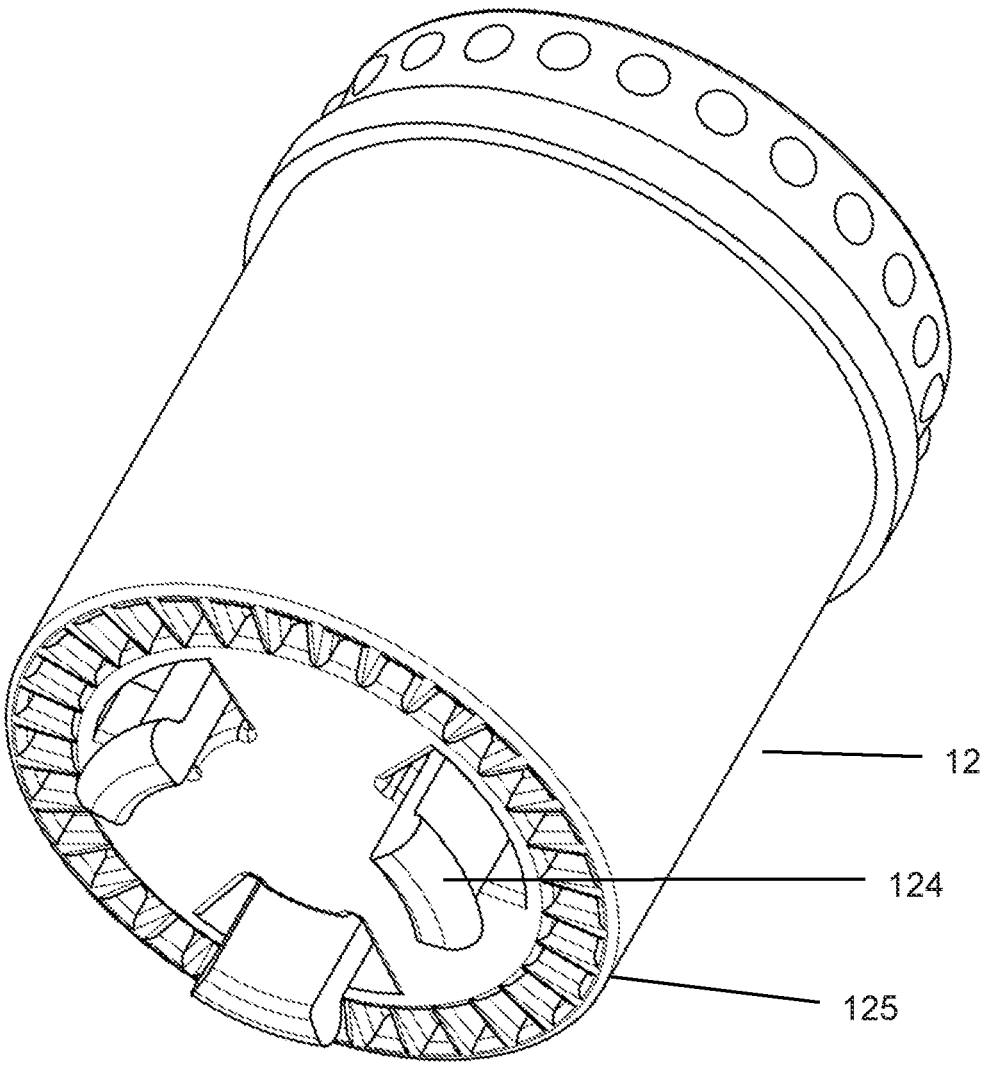
FIG. 13 is a perspective view of the refill stick receptacle of the second embodiment.

FIGS. 11 to 13 illustrate the second preferred embodiment of the present invention. In this embodiment, means for removably engaging the dispenser stick receptacle 21 with the stick receptacle carrier 23, and the refill stick receptacle 12 with the stick receptacle carrier 23 are mechanical means. More particularly, the dispenser stick receptacle 21 is provided with a plurality of L-shaped legs 212 at the bottom end 213 thereof; the plurality of L-shaped legs 212 snap into engagement with an opening 231 at the bottom end 232 of the stick receptacle carrier 23 so as to establish the third retention force between the dispenser stick receptacle 21 and the stick receptacle carrier 23. The refill stick receptacle 12 is provided with a plurality of L-shaped legs 124 at the bottom end 125 thereof; the plurality of L-shaped legs 124 snap into engagement with the opening 231 at the bottom end 232 of the stick receptacle carrier 23 so as to establish the fifth retention force between the refill stick receptacle 12 and the stick receptacle carrier 23. Other features of this embodiment are substantially similar to those of the first embodiment and are therefore not repeated herein.

The embodiments described above are exemplary embodiments of the present invention. It is understood that the present invention should not be limited to the embodiments as described. Any changes, modifications, replacements, combinations and simplification without deviating from the essence and principle of the present invention should be considered alternative configurations that are equally effective and should also fall within the scope of protection of the present invention.

What is claimed is:

1. A system for refilling a dispenser comprising:

a refill assembly comprising a refill base;

a refill stick receptacle which retains a refill stick product;

a refill cover;

a dispenser comprising a dispenser stick receptacle which retains a dispenser stick product;

a stick receptacle carrier;

a propel-repel mechanism for longitudinally advancing and retracting the stick receptacle carrier within the dispenser;

wherein the refill base is removably engaged with the refill stick receptacle and/or the refill cover with a first retention force therebetween; the refill cover is removably engaged with the refill stick receptacle with a second retention force therebetween; the second retention force is higher than the first retention force;

the dispenser stick receptacle is removably engaged with the stick receptacle carrier with a third retention force therebetween; the refill base is removably engaged with the dispenser stick receptacle with a fourth retention force therebetween; the fourth retention force is higher than the third retention force;

the refill stick receptacle is removably engaged with the stick receptacle carrier with a fifth retention force therebetween; the fifth retention force is higher than the second retention force;

the dispenser stick receptacle is configured to be replaced by the refill stick receptacle by (1) removing the refill base from the refill cover with the refill stick receptacle engaged with the refill cover; (2) engaging the refill base with the dispenser stick receptacle and then removing the dispenser stick receptacle from the stick receptacle carrier by pulling the refill base away from the stick receptacle carrier; (3) engaging the refill cover with the refill stick receptacle engaged therewith with the stick receptacle carrier; and (4) removing the refill cover by pulling the refill cover away from the stick receptacle carrier.

2. The system as in claim 1, wherein the refill base is removably engaged with the refill stick receptacle and/or the refill cover by mechanical or magnetic means; the refill cover is removably engaged with the refill stick receptacle by mechanical or magnetic means; the dispenser stick receptacle is removably engaged with the stick receptacle carrier by mechanical or magnetic means; the refill base is removably engaged with the dispenser stick receptacle by mechanical or magnetic means; the refill stick receptacle is removably engaged with the stick receptacle carrier by mechanical or magnetic means.

3. The system as in claim 2, wherein the mechanical or magnetic means for removably engaging the refill cover with the refill stick receptacle is substantially the same as the mechanical or magnetic means for removably engaging the refill base with the dispenser stick receptacle; the mechanical or magnetic means for removably engaging the dispenser stick receptacle with the stick receptacle carrier is substantially the same as the mechanical or magnetic means for removably engaging the refill stick receptacle with the stick receptacle carrier.

4. The system as in claim 1, wherein the refill base has an upper portion proximal to the refill stick receptacle, and the upper portion of the refill base is engaged with an upper portion of the dispenser stick receptacle which is distal from the stick receptacle carrier.

5. The system as in claim 1, wherein the refill base is provided with a plurality of vertical ribs extending from an inner wall thereof; the plurality of vertical ribs are in friction fit with an outer wall of the refill stick receptacle so as to establish the first retention force between the refill base and the refill stick receptacle.

6. The system as in claim 1, wherein the refill cover has a bottom edge which is in friction fit or snap fit with a peripheral rim of the refill base so as to establish the first retention force between the refill base and the refill cover.

7. The system as in claim 1, wherein the refill cover is provided with an annular rib around an inner wall thereof; the refill stick receptacle is provided with a plurality of beads around an outer wall thereof and an annular limiting rib below the plurality of beads; the annular rib is removably engaged with the plurality of beads so as to establish the second retention force between the refill cover and the refill stick receptacle, and the annular rib is limited in position by the annular limiting rib when engaging with the plurality of beads.

8. The system as in claim 1, wherein the dispenser stick receptacle is provided with a plurality of L-shaped legs at a bottom end thereof; the plurality of L-shaped legs snap into engagement with an opening at a bottom end of the stick receptacle carrier so as to establish the third retention force between the dispenser stick receptacle and the stick receptacle carrier.

9. The system as in claim 1, wherein a metal plate is fastened at a bottom end of the dispenser stick receptacle; a magnet magnetically attractive to the metal plate is affixed at a bottom end of the stick receptacle carrier so as to establish the third retention force between the dispenser stick receptacle and the stick receptacle carrier.

10. The system as in claim 1, wherein the refill base is provided with an annular rib around an inner wall thereof; the dispenser stick receptacle is provided with a plurality of beads around an outer wall thereof and an annular limiting rib below the plurality of beads; the annular rib is removably engaged with the plurality of beads so as to establish the fourth retention force between the refill base and the dispenser stick receptacle, and the annular rib is limited in position by the annular limiting rib when engaging with the plurality of beads.

11. The system as in claim 1, wherein the refill stick receptacle is provided with a plurality of L-shaped legs at a bottom end thereof; the plurality of L-shaped legs snap into engagement with an opening at a bottom end of the stick receptacle carrier so as to establish the fifth retention force between the refill stick receptacle and the stick receptacle carrier.

12. The system as in claim 1, wherein a metal plate is fastened at a bottom end of the refill stick receptacle; a magnet magnetically attractive to the metal plate is affixed at a bottom end of the stick receptacle carrier so as to establish the fifth retention force between the refill stick receptacle and the stick receptacle carrier.

* * * * *